US012716041B2

(12) United States Patent
Swanson

(10) Patent No.: US 12,716,041 B2
(45) Date of Patent: Aug. 25, 2026

(54) FIRESTARTER DEVICE

(71) Applicant: Scott J. Swanson, Pecatonica, IL (US)

(72) Inventor: Scott J. Swanson, Pecatonica, IL (US)

( * ) Notice: Subject to any disclaimer, the term of this patent is extended or adjusted under 35 U.S.C. 154(b) by 0 days.

(21) Appl. No.: 19/083,731

(22) Filed: Mar. 19, 2025

(65) Prior Publication Data

US 2025/0297181 A1 Sep. 25, 2025

Related U.S. Application Data

(60) Provisional application No. 63/568,555, filed on Mar. 22, 2024.

(51) Int. Cl.
*C10L 5/36* (2006.01)

(52) U.S. Cl.
CPC ..... *C10L 5/36* (2013.01)

(58) Field of Classification Search
CPC .... C10L 5/36; C10L 2200/0469; C10L 11/04; C10L 11/06
USPC ..... 44/520–522, 530
See application file for complete search history.

(56) References Cited

U.S. PATENT DOCUMENTS

| | | | | |
|---|---|---|---|---|
| 154,796 | A | | 9/1874 | Husbands, Jr. |
| RE6,246 | E | * | 1/1875 | Husbands ..... 44/519 |
| 201,184 | A | | 3/1878 | Lewis |
| 248,849 | A | | 11/1881 | Eddy |
| 4,952,217 | A | | 8/1990 | Porter |
| 6,071,320 | A | | 6/2000 | Meske |

FOREIGN PATENT DOCUMENTS

| | | | |
|---|---|---|---|
| CH | 695496 | A5 | 6/2006 |
| DE | 521202 | C | 3/1931 |
| DE | 843250 | C | 7/1952 |
| DE | 3608969 | A1 | 9/1987 |
| DE | 202004007582 | U1 | 9/2004 |
| GB | 190502599 | A | 11/1905 |
| WO | WO 2008/036028 | A1 | 3/2008 |
| WO | WO 2022/187873 | A1 | 9/2022 |

* cited by examiner

*Primary Examiner* — Cephia D Toomer
(74) *Attorney, Agent, or Firm* — Reinhart Boerner Van Deuren P.C.

(57) ABSTRACT

A firestarter includes an integral block of wood of six sides. A slat and groove portion extends from an outermost bottom surface of a bottom side towards a top wall of the top side. The slat and groove portion includes a plurality of slats and a plurality of grooves. Each slat of the plurality of slats has a slat width and each groove of the plurality of grooves has a groove width. The slat width and the groove width are the same. The plurality of grooves extend through the front side, the back side and the bottom side and the plurality of grooves do not extend through the first side, the second side, and the top side.

22 Claims, 5 Drawing Sheets

FIRESTARTER DEVICE

CROSS-REFERENCE TO RELATED PATENT APPLICATIONS

This Patent Application claims the benefit of U.S. Provisional Patent Application No. 63/568,555, filed Mar. 22, 2024, the entire teachings and disclosure of which are incorporated herein by reference thereto.

FIELD OF THE INVENTION

This invention generally relates to firestarters, more particularly to wood block firestarters without accelerants.

BACKGROUND OF THE INVENTION

Starting fires with wood kindling is well known. Typically, the wood kindling is ignited with paper such as newspapers. The newspapers are ignited by a heat source such as a match or lighter. Once the newspapers are ignited, they burn of sufficient duration, intensity, and area that the newspapers are able to ignite the wood kindling. The wood kindling then is used to ignite a further combustion source that is typically larger than the kindling and more difficult to light that the newspapers and the kindling. The further combustion source is typically larger wood, for example a wood log used to make a fire in a home fireplace or outdoor fire.

Efforts in the past have sought to eliminate the need for using newspapers and kindling by providing a firestarter that can be ignited by a heat source and can in turn ignite a larger combustible object such as the wood log discussed above. For example, in international publication WO2022/187873, a separable wood block is provided that includes slats and grooves. Individual slats are broken off the block and arranged such that they ignited after they have been removed from the block. Designs of this type have been found to be cumbersome because the slats must be broken off the block, then arranged and only thereafter ignited with a fuel source.

The firestarter in international publication WO 2008/036028 contains grooves and slats. The grooves run in different directions and the slats vary in thickness. The block may be broken apart to provide kindling pieces or the block itself may be lit. However, the design has proved problematic because of the ease of breaking apart the slats to use as smaller kindling and because its arrangement of slats and grooves have proven less than optimal in the time it takes to light and to light larger pieces of wood needed to sustain combustion in a fire.

CH-695496 discloses a firestarter that is a wood block with grooves and slats. However, it is recognized that the arrangement of the slat and grooves are not sufficient to timely light the firestarter and therefore, a "rapid combustion substance" is used with the wood block to facilitate lighting the firestarter. This further application of a rapid combustion substance increases production costs as extra material to purchase and extra labor to apply. Moreover, the additional rapid combustion substance raises environment concerns as well as safety for the user handling the chemical combustion substance.

DE3608969 discloses a slat and groove firestarter. However, its grooves that include its central incision-chimney extend through all of its six of sides. This structure decreases the block's stability. Moreover, its match like portions that are designed to ignite first may be too easily broken off. Still further, its structure creates a combustion that may be too rapid such that it may not burn of a duration long enough to ignite the wood it is intended to ignite to sustain the desired combustion in the fireplace or outdoor arrangement.

Therefore, to date, firestarter designs have been made to break apart, making the block unstable for shipping and handling when starting a fire. So too, hereto for the known firestarters do not ignite and burn at the desired rate. Heretofore, firestarters have been designed to be broken apart as kindling and then lit which is far too awkward and cumbersome and slow when a fire is desired. Other designs are not sufficient to easily ignite and an accelerant, that is a "rapid combustion substance" must be used. Yet, other designs have too many grooves such that the burn rate is too fast once ignited and/or the firestarter block is not stable and may break apart too easily for shipment and eventual handling at the fire.

BRIEF SUMMARY OF THE INVENTION

The invention provides a firestarter that is a wood block that is made from one piece of wood. By one piece of wood, it is meant a monolithic block and not several pieces that are joined by a bond or fastener. This structural element is necessary to control the rate of ignition and burn of the firestarter. In other words, if multiple elements are joined instead of formation via a monolithic block, then the joining together of various components would change the rate of ignition and burn because the bonding material may act as an accelerant or retardant. So too fasteners can inhibit the burn rate.

The firestarter includes a front channel located radially inward of the outermost surface of the font side while a back channel is located radially inward of the outermost surface of the back side. Thus, the channels are inset into the block on the two opposing sides of the block. Between the front and back channels is a slat and groove portion. When a flame is presented to the bottom side of the block about the center slats of the slat and groove portion, oxygen is channeled into the front channel and the back channel and in turn into the grooves of the slat and groove portion, thus the slats of the slat and groove portion are surrounded by oxygen. The slats and grooves have the same width so as to properly proportion and provide sufficient oxygen around the slats such that they provide for the correct rate of ignition. Thus, the channels and the slat and groove portion work together to provide the proper ignition rate to the slats as well as the desired burn rate that is constant and sustained. Thus, these features provide for an optimum use of heat, fuel, and oxygen, commonly referred to as the fire triangle.

The slats are first incendiary portions. This ignition takes place without any use of accelerants on the slats, the wood block or in the grooves or anywhere on or about the firestarter. Once the slats ignite, they burn at an optimum rate, based on their dimensions and geometry such that they ignite a top wall of the block and two opposing side walls of the wood block. The top wall the two opposite side walls may be considered as secondary incendiary portions that burn sufficiently long to set fire to and allow for timely combustion of larger pieces of wood such as logs in a fireplace or outdoor fire pit such that combustion can be sustained therein.

These and other advantages of the invention, as well as additional inventive features, will be apparent from the description of the invention provided herein.

In one aspect, the invention provides a firestarter that is an integral block of wood of six sides. The six sides are a top side opposite a bottom side. The first side is opposite a second side. The first side and the second side extend between the top side and the bottom side. A front side is opposite a back side. The front side and the back side each extend between the first side and the second side and between the top side and the bottom side. A slat and groove portion extend from an outermost bottom surface of the bottom side towards a top wall of the top side. The slat and groove portion includes a plurality of slats and a plurality of grooves. Each slat of the plurality of slats has a slat width and each groove of the plurality of grooves has a groove width. The slat width and the groove width are the same. The plurality of grooves extend through the front side, the back side and the bottom side. The plurality of grooves do not extend through the first side, the second side and the top side.

Embodiments of the invention include any one or more of the following features:

Feature: The top wall extends between a top surface of the top side and a concave surface located between the top side and the bottom side. The concave surface is a top wall bottom surface. Each groove of the plurality of grooves extending from the top wall bottom surface to the outermost bottom surface.

Feature: A depth measured from the top surface to the concave surface is at least twice the slat width.

Feature: The concave surface comprises a first stepped surface intersecting a second stepped surface.

Feature: The concave surface faces the bottom side.

Feature: The top side includes a top outermost solid planar surface extending from the first side to the second side and from the front side to the back side.

Feature: The first side includes a first outermost solid planar surface extending from the front side to the back side and from the top side to the bottom side. The second side includes a second outermost solid planar surface extending from the first side to the second side and from the front side to the back side.

Feature: The back side defines a back channel into the back side, the back channel extending from the bottom side to the top side. The back channel defines a back channel bottom radially inward of an outermost portion of the back side. The front side defines a front channel in the front side. The front channel extends from the bottom side to the top side. The front side defines a front channel bottom radially inward of an outermost portion of the front side.

Feature: The slat and groove portion extends between the back channel and the front channel.

Feature: The front channel includes a first channel wall extending from the front channel bottom. A second channel wall opposite the first channel wall extends from the front channel bottom.

Feature: The back channel includes a third channel wall extending from the back channel bottom. A fourth channel wall extends from the back channel bottom.

Feature: The first channel wall width is measured from the first outermost solid planar surface to an innermost surface of the first channel wall. The second channel wall width is measured from the second outermost solid planar surface to a second innermost surface of the second channel wall. The first channel wall width and the second channel wall width are the same.

Feature: The first channel wall width and the second channel wall width are each twice as wide as the slat width.

Feature: The third channel wall width is measured from the first outermost solid planar surface to an innermost side of the third channel wall. The fourth channel wall width is measured from the second outermost solid planar surface to the innermost side of the fourth channel wall. The third channel wall width and the fourth channel wall width are the same as the first channel wall width and the second channel wall width.

Feature: Each groove of the plurality of grooves has an opening aperture defined by the bottom surface.

Feature: The plurality of grooves includes a center groove bisected by a center axis of the integral block of wood. The center axis extends through the bottom side and the top side and bisects a length of the integral block of wood. The length is the distance measured normal to the center axis and from the first side and the second side.

Feature: A first groove of the plurality of grooves is located proximate the first side. Proceeding in a direction from the first groove to the center groove, each groove of the plurality of grooves increases in groove depth. The groove depth is defined as extending between a bottom surface of the bottom side and the concave surface. The groove depth of the center groove is a center depth. The center depth is greater than the groove depth of each groove of the plurality of grooves that is not the center groove.

Feature: A last groove of the plurality of grooves is located proximate the second side. Proceeding in the direction from the center groove to the last groove of the plurality of grooves, the groove depth decreases.

Feature: Each groove of the plurality of grooves defines a respective groove center axis. The grooves of the plurality of grooves that are located the same groove distance from the center axis of the of the center groove have the same groove depth. The groove distance is measured from the center axis of the center groove to the respective center groove axis.

Feature: The top side defines a top surface having the shape of the capital letter I.

Feature: The top wall includes a first channel spaced apart from a second channel in parallel relation. The first channel and the second channel extend between and completely through the first side and the second side of the firestarter.

Feature: The first channel extends from the top surface of the top wall through the concave surface of the top wall to a first channel bottom. The second channel extends from the top surface of the top wall through the concave surface of the top wall to a second channel bottom.

Feature: A first plurality of linearly arrayed through-apertures are defined by the first channel bottom and fluidly connect the first channel with each one of the plurality of grooves, wherein a second plurality of linearly arrayed through-apertures are defined by the second channel bottom and fluidly connect the second channel with each one of the plurality of grooves.

Other aspects, objectives and advantages of embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
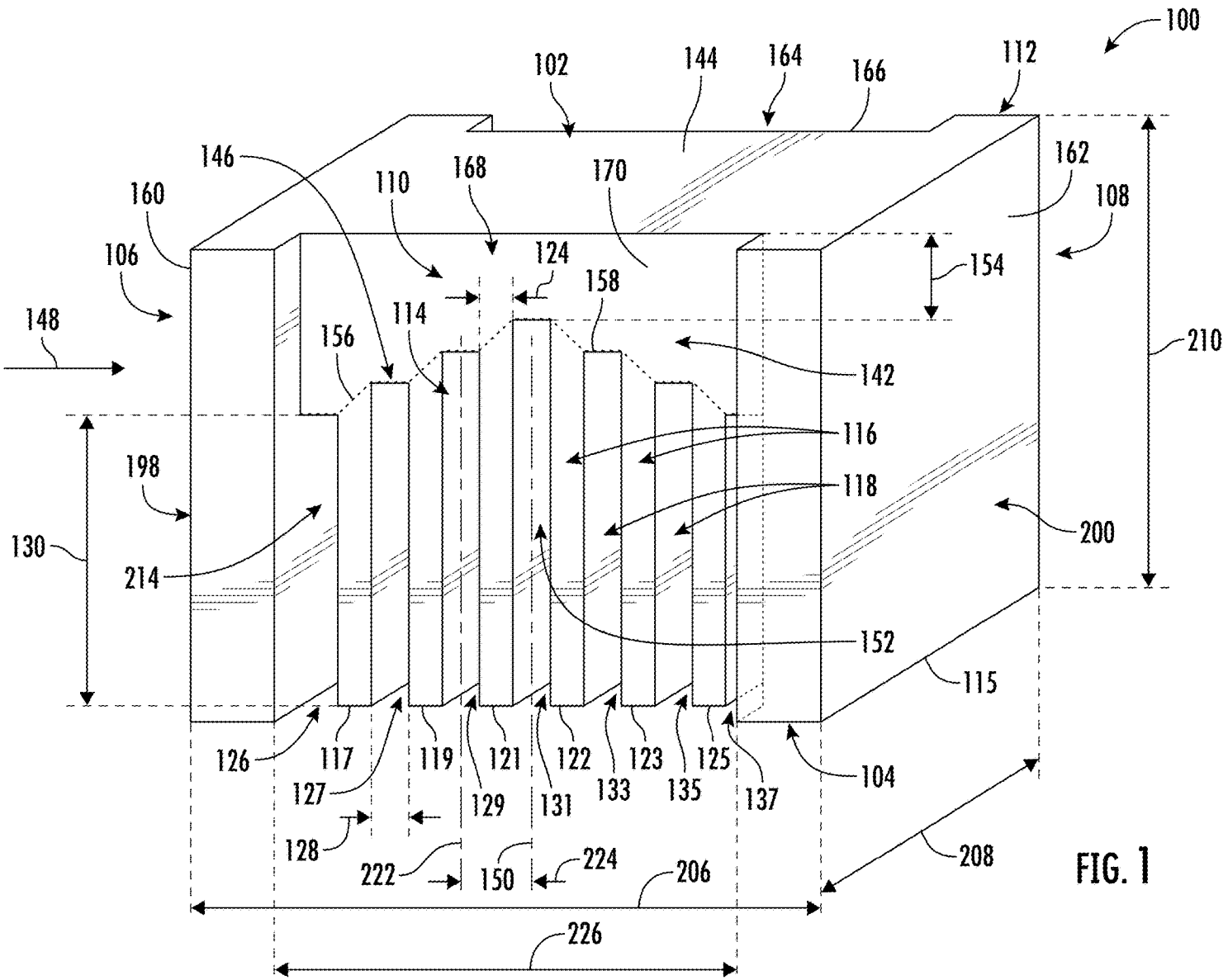
FIG. 1 is a front right side and topside isometric view of a firestarter according to the teachings of the instant invention.

FIG. 1 illustrates a firestarter 100 according to the teachings of the instant invention. The firestarter 100 is made from an integral block of wood. By integral, it is meant a monolithic block of wood. The firestarter 100 has six sides 102, 104, 106, 108, 110, 112. The firestarter 100 has a top side 102 opposite a bottom side 104. A first side 106 is located opposite a second side 108. The first side 106 and the second side 108 extend between the top side 102 and the bottom side 104.

A front side 110 is located opposite a back side 112. The front side 110 and the back side 112 each extend between the first side 106 and the second side 108 and between the top side 102 and the bottom side 104. A slat and groove portion 114 extend from the bottom side 104 towards the top side 102. The slat and groove portion 114 includes a plurality of slats 116 (FIG. 3) and a plurality of grooves 118 (FIG. 3).

Figure 3:
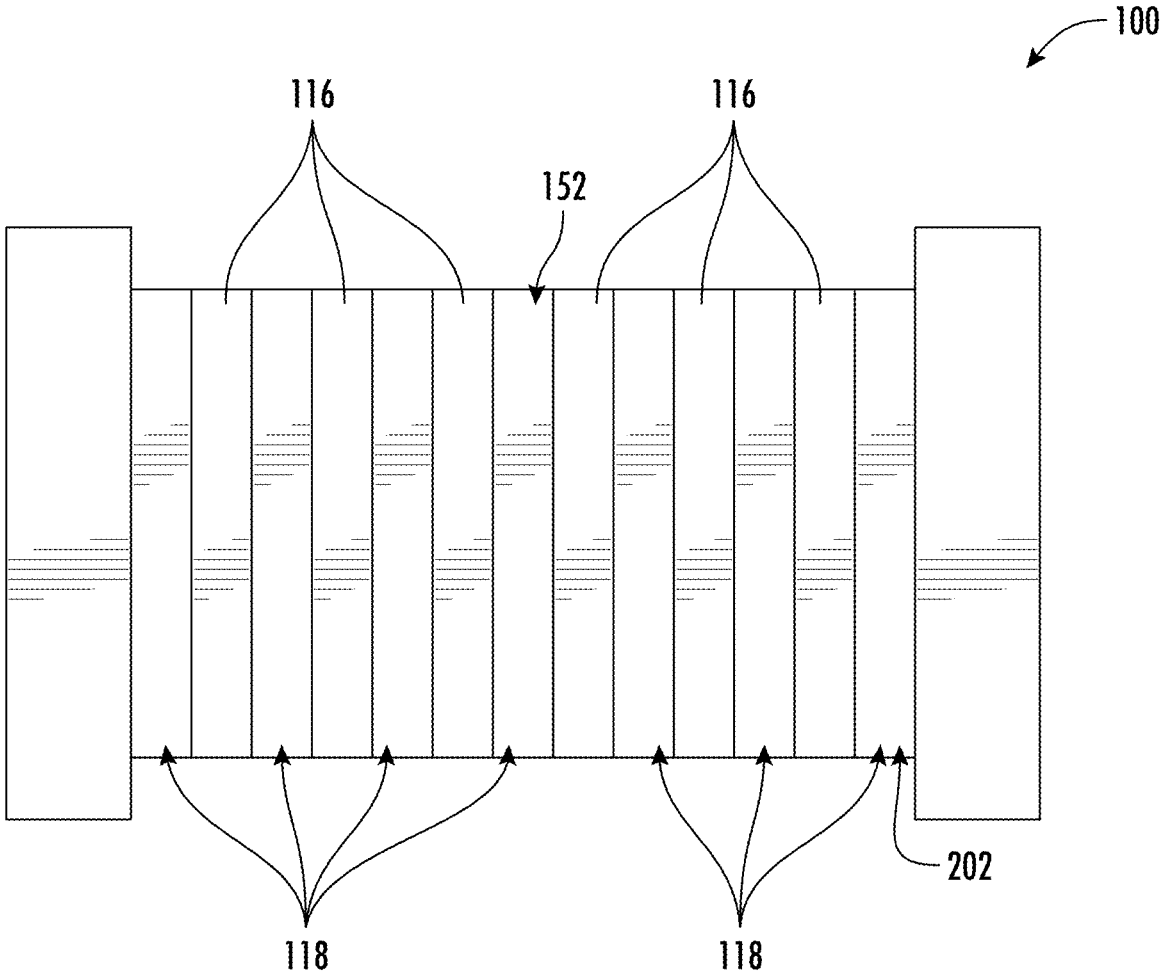
FIG. 3 is a bottom view of the firestarter of FIG. 1.

A bottom surface 115 (FIG. 3) of the firestarter 100 defines a planar bottom surface for each slat 117, 119, 121, 122, 123, 125 of the plurality of slats 116 (FIG. 3). Each one of the plurality of slats 116 (FIG. 3) has a slat width 124 and each groove 126, 127, 129, 131, 133, 135, 137 of the plurality of grooves 118 (FIG. 3) has groove width 128. The slat width 124 and the groove width 128 are the same for each slat 117, 119, 121, 122, 123, 125 of the plurality of slats 116 (FIG. 3) and each groove 126, 127, 129, 131, 133, 135, 137 of the plurality of grooves 118 (FIG. 3). The equality in width ensures sufficient oxygen is available to surround the slats 117, 119, 121, 122, 123, 125 of the plurality of slats 116 (FIG. 3) via the grooves 126, 127, 129, 131, 133, 135, 137 of the plurality of grooves 118 (FIG. 3) such that a heat source is able to ignite the plurality of slats 116 (FIG. 3) in a timely manner yet control the rate of the burn of the plurality of slats 116 (FIG. 3) such that the firestarter 100 burns sufficiently hot enough and long enough to ignite a further fuel source such as wood in an outside burn pit or a log in a fireplace.

The dimension of the plurality of slats 116 (FIG. 3) and the plurality of grooves 118 (FIG. 3) provide for an optimum use of heat, fuel and oxygen, commonly referred to as the fire triangle. This optimized arrangement facilitates initial timely ignition of the plurality of slats 116 (FIG. 3) followed by a burn rate that is not too rapid but slow enough to cause a secondary ignition in the firestarter 100, namely the second ignition elements that are a top wall 142, a first side wall 198 and a second side wall 200. These second ignition elements may be considered secondary ignition walls that are used ignite a larger combustible such as a log for an indoor fireplace or log or wood or other organic materials in an outdoor fire pit.

The plurality of grooves 118 open only to the bottom side 104, the front side 110, and the back side 112. The plurality of grooves do not open to the top side 102, the first side 106 or the second side 108. More specifically, there are not openings to the plurality of grooves 118 because the top side defines a top surface 144 that is planar and does not define any openings into the plurality of grooves 118. The first side 106 defines a first surface 160 that is planar and does not define any openings into the plurality of grooves 118. The second side defines a second surface 162 that is planar and does not define any openings into the plurality of grooves 118.

The top wall 142 extends between the top surface 144 that is a planar outermost surface of the top side 102 and a concave surface 146 that opens toward the bottom side 104. By concave surface, it is meant the concave surface 146 shown in FIG. 1 which is a defined by a line extending between ends of the plurality of grooves 118. The concave surface 146 is spaced between the top side 102 and the bottom side 104. The concave surface 146 is a top surface for each groove 126, 117, 129, 131, 133, 135, 137 of the plurality of grooves 118 (FIG. 3) of the slat and groove portion 114. A groove depth 130 is measured for each groove 126, 127, 129, 131, 133, 135, 137 between the concave surface 146 and the bottom side 104 along a groove center axis 222 that is a longitudinal axis defined by each groove 126, 127, 129, 131, 133, 135, 137.

The concave surface 146 ensures each groove 126, 127, 129, 131, 133, 135, 137 of the plurality of grooves 118 (FIG. 3) increases in groove depth 130 proceeding in a first direction 148 from the first side 106 to a center axis 150 of the firestarter 100 and decreases in groove depth 130 in a direction 148 proceeding from the center axis 150 towards the second side 108. The center axis 150 bisects the firestarter 100 in extension through the top side 102 and the bottom side 104 and defines the center axis of center groove 131. Because the groove depth 130 is greatest at the center axis 150 and the least proximate the first side 106 and the second side 108, this structure permits an advantageous focused flame along the center axis 150 which is also the center axis of a center groove 131 of the plurality of grooves 118 (FIG. 3). This permits a flame to spread up the center groove 131 and along the slats 117, 119, 121, 122, 123, 125 to facilitate their ignition and rate of burn.

A depth 154 measured from the top surface 144 to the concave surface 146 is at least twice a slat width 124 of each slat 117, 119, 121, 122, 123, 125 of the plurality of slats 116 (FIG. 3). The concave surface 146 is generally in the shape formed by a first stepped surface 156 meeting a second stepped surface 158 as shown in the dashed lines at FIG. 1.

No portion of any groove 126, 127, 129, 131, 133, 135, 137 of the plurality of grooves 118 (FIG. 3) extends through the top surface 144, the first side 106, or the second side 108. The top side 102 includes the top surface 144. The top surface 144 is an outermost solid planar surface extending from the first side 106 to the second side 108 and from the front side 110 to the back side 112.

The first side 106 includes a first surface 160 that is an outermost solid planar surface extending from the front side 110 to the back side 112 and from the top side 102 to the bottom side 104. The second side 108 includes a second surface 162 that is an outermost solid planar surface extending from the first side 106 to the second side 108 and from the front side 110 to the back side 112 such that the top surface is in the shape of capital letter I.

The back side 112 of the firestarter 100 includes a back channel 164 therein. The back channel 164 extends from the bottom side 104 to the top side 102. The back side 112 defines a back channel bottom 166.

The front side 110 of the firestarter includes a front channel 168 therein. The front channel 168 extends from the bottom side 104 to the top side 102. The front side 110 defines a front channel bottom 170. The slat and groove portion 114 extends between the back channel 164 and the front channel 168 and between the concave surface 146 and the bottom surface 115.

Figure 2:
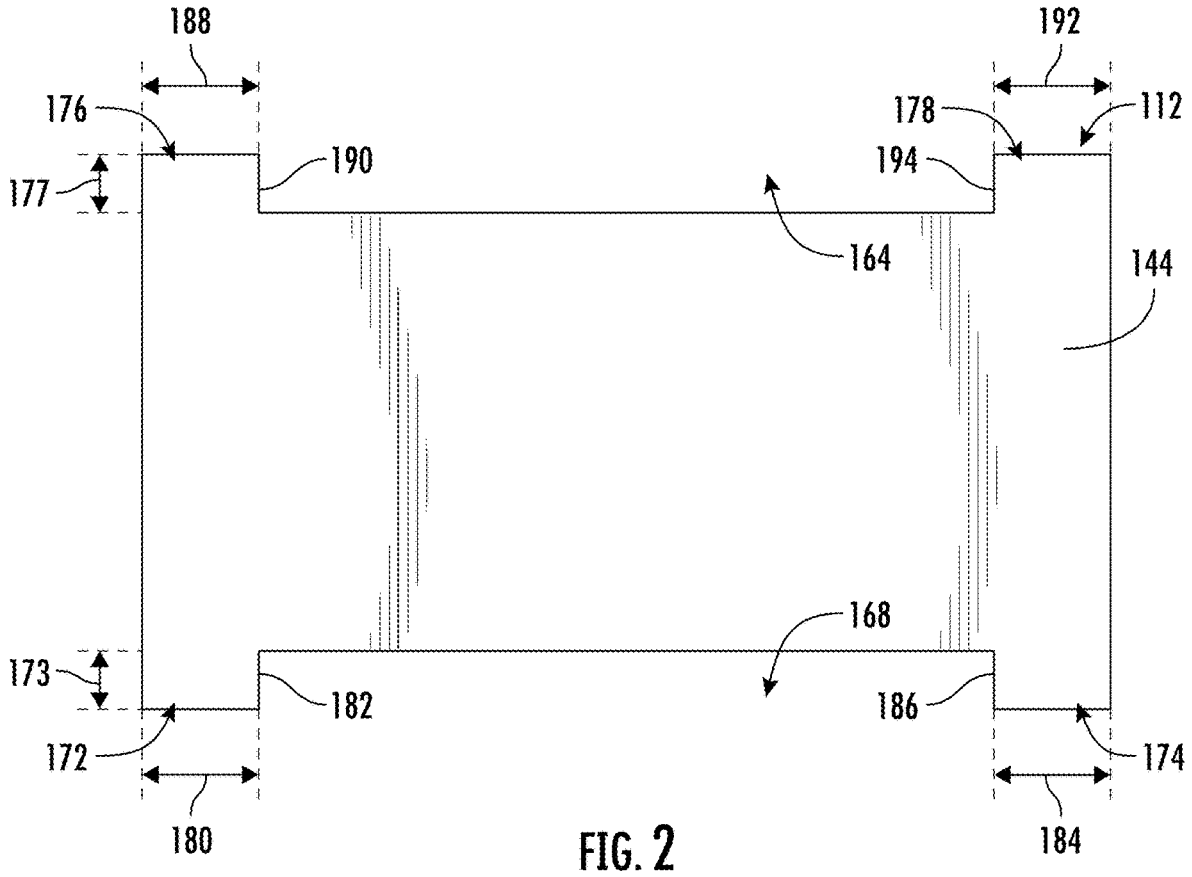
FIG. 2 is a top view of the firestarter of FIG. 1.

The front channel 168 includes a first channel wall 172 (FIG. 2) extending from the front channel bottom 170 to define a front channel depth 173. The front channel 168 includes a second channel wall 174 (FIG. 2) opposite the first channel wall 172 (FIG. 2). The second channel wall 174 (FIG. 2) extends from the front channel bottom 170. The back channel 164 includes a third channel wall 176 (FIG. 2) extending from the back channel bottom 166 to define a back channel depth 177 and a fourth channel wall 178 (FIG. 2) extending from the back channel bottom 166.

A first channel wall width 180 (FIG. 2) of the first channel wall 172 (FIG. 2) is measured from the first surface 160 that is an outermost solid planar surface of the first side 106 to an innermost surface 182 (FIG. 2) of the first channel wall 172 (FIG. 2). Outermost and innermost are understood relative to radial directions from the center axis 150. A second channel wall width 184 (FIG. 2) of the second channel wall 174 (FIG. 2) is measured from the second surface 162 of the second side 108 that is an outermost solid planar surface to a second innermost surface 186 (FIG. 2) of the second channel wall 174 (FIG. 2). The first channel wall width 180 (FIG. 2) and the second channel wall width 184 (FIG. 2) are the same.

The first channel wall width 180 (FIG. 2) and the second channel wall width 184 (FIG. 2) are each twice as wide as the slat width 124 of each slat 117, 119, 121, 122, 123, 125 of the plurality of slats 116 (FIG. 3).

A third channel wall width 188 (FIG. 2) of the third channel wall 176 (FIG. 2) is measured from the first surface 160 that is an outermost solid planar surface of the first side 106 to a third innermost surface 190 (FIG. 2) of the third channel wall 176 (FIG. 2). The fourth channel wall width 192 (FIG. 2) of the fourth channel wall 178 (FIG. 2) is measured from the second surface 162 that is an outermost solid planar surface of the second side 162 to the fourth innermost surface 194 of the fourth channel wall 178 (FIG. 2). The third channel wall width 188 (FIG. 2) and the fourth channel wall width 192 (FIG. 2) are the same as the first channel wall width 180 (FIG. 2) and the second channel wall width 184 (FIG. 2).

The first channel wall 172 (FIG. 2) and the third channel wall 176 (FIG. 2) are part of the first side wall 198 including the first side 106 and the first innermost surface 182 (FIG. 2) and the third innermost surface 190 (FIG. 2). The second channel wall 174 (FIG. 2) and the fourth channel wall 178 (FIG. 2) are part of the second side wall 200 including the second side 108 and the second innermost surface 186 (FIG. 2) and the fourth innermost surface 194 (FIG. 2). The first side wall 198 and the second side wall 200 have the same dimensions and thus the same burn rate.

The third channel wall width 188 (FIG. 2) and the fourth channel wall width 192 (FIG. 2) are each twice as wide as the slat width 124 of each slat 117, 119, 121, 122, 123, 125 of the plurality of slats 116 (FIG. 3). The depth 154 that is a thickness of the top wall 142 is also at least twice as wide as the slat width 124 of each slat 117, 119, 121, 122, 123, 125 of the plurality of slats 116 (FIG. 3).

Each groove 126, 127, 129, 131, 133, 135, 137 of the plurality of grooves 118 (FIG. 3) has a respective opening aperture 202 defined by the bottom side 104.

The plurality of grooves 118 (FIG. 3) includes the center groove 131 bisected by the center axis 150 of the firestarter 100. The center axis 150 extends through the bottom side 104 and the top side 102 and thereby bisects a block length 206 of the firestarter 100. The block length 206 is the distance measured normal to the center axis 150 and from the first surface 160 of the first side 106 to the second surface 162 of the second side 108. A block depth 208 is measured from the front side to the back side and normal to the center axis 150. A block height 210 is measured in a direction parallel to the center axis 150 and is measured from the top surface 144 to the bottom surface 115 that is an outermost surface of the bottom side 104. By outermost, it is mean in an axial direction parallel to the center axis 150.

A first groove 126 of the plurality of grooves 118 (FIG. 3) is located proximate the first side 106. Proceeding in the direction 148 from the first groove 126 to the center groove 131, each successive groove 127 and groove 129 increases in groove depth 130. The groove depth 130 of groove 129 is greater than that of groove 127 which is greater than that of groove 126. The groove depth 130 of the center groove 131 is greater than the groove depth 130 of grooves 126, 127, 129, 133, 135, 137 of the plurality of grooves 118 (FIG. 3).

A last groove 137 of the plurality of grooves 118 (FIG. 3) is located proximate the second side 108. Proceeding in the direction from the center groove 131 to the last groove 137 of the plurality of grooves 118 (FIG. 3) the groove depth 130 of grooves 135 and 137 decreases. The groove depth 130 of the center groove 131 is greater than the groove depth 130 of groove 133 which is greater than the groove depth 135 which is greater than the groove depth 137.

Each groove 126, 127, 129, 131, 133, 135, 137 of the plurality of grooves 118 (FIG. 3) defines a respective groove center axis 222 (FIG. 3) extending between the front side 110 and the back side 112. Each respective groove center axis 222 (FIG. 3) that is located the same groove distance 224 (FIG. 3) from the center axis 150 (FIG. 3) of the center groove 131 (FIG. 3) has the same groove depth 130. The groove distance 224 (FIG. 3) being measured from the center axis 150 of the center groove 131 to the respective groove center axis 222. Thus, grooves 126 and 137 have the same groove depth 130. Grooves 127 and 35 have the same groove depth 130 that is greater than the groove depth 130 of the grooves 126 and 137. Grooves 129 and 131 have the same groove depth 130 that is greater than the groove depth 130 of the grooves 127 and 135.

The top side 102 that includes the top surface 104 is in the geometrical shape of a capital letter I.

The dimensions, proportions, and spacings of the first side wall 198 and the second side wall 200 and the top wall 142 and the slats 117, 119, 121, 122, 123, 125 and the grooves 126, 127, 129, 131, 133, 135, 137 ensure the slats 117, 119, 121, 122, 123, 125 are the first incendiary elements to ignite and burn when a flame is placed about the center axis 150.

Once the first incendiary elements, namely the plurality of slats 116 (FIG. 3) begin burning, then the secondary incendiary elements, namely the top wall 142, the first side wall 198 and the second side wall 200 ignite and begin to burn. Thus, the slat width 124 and the first channel wall width 180 (FIG. 2), the second channel wall width 184 (FIG. 2) and the depth 154 of the top wall 142 are important to determine not only first incendiary elements and second incendiary elements, but also the rate and order in which they burn so as to ultimately ignite a third incendiary source such as a log (not illustrated).

In a preferred embodiment, the dimensions, proportions, and spacings are disclosed herein. However, it should be understood, the dimensions given can vary by tolerance based on the tool or method used to for the firestarter 100, and each dimension might have a tolerance of plus or minus one millimeter of what is disclosed. The intent is to dimension in such a way that the firestarter 100 is easily handled in one hand so as to be able to easily position it relative to a heat source igniting the firestarter 100 and without having to put the firestarter 100 on the ground, which may be wet and prohibit ignition. Firestarter block length 206 is 68 millimeters (hereafter, "mm"). The block depth 208 is 38 mm. The block height 210 is 45 mm. The front channel 168 has a length 226 of 52 mm between the first channel wall 172 and the second channel wall 174. The front channel depth 173 (FIG. 2) is 4 mm. The back channel depth 177 (FIG. 2) is 4 mm. Grooves 126 and 137 each have a groove depth 130 of 26 mm and each groove 126, 137 has a groove width 128 of 4 mm. Grooves 127 and 135 each have a groove depth of 30 mm, and each have a groove width 124 of 4 mm. Grooves 129 and 135 each have a groove depth of 34 mm and a groove width 124 of 4 mm. Center groove 131 has a groove depth of 38 mm and a groove width 125 of 4 mm.

In an embodiment, the firestarter 100 is held in one hand while a heat source such as a lit match is held in the other hand. The heat source ignites the bottom 115 surface of the firestarter 100 while at the same time flames are focused within the front channel 168 and the back channel 166 as they spread in a direction extending from the bottom surface 115 to the concave surface 146 and in the plurality of grooves 118 (FIG. 3) to ignite the faces of the plurality of slats 116 (FIG. 3) facing the plurality of grooves 118 (FIG. 3). No accelerant is used on the firestarter 100. The dimensions of the plurality of the slats 116 and the plurality of the grooves 118 together with the front channel 168 and the back channel 164 are such that the ignition of the plurality of the slats is timely and the burn rate is sufficient being neither to fast nor too slow.

Once the plurality of slats 116 (FIG. 3) are lit, then the top wall 142, the first side wall 198, and the second side wall 200 as second ignition elements are ignited. Once these second ignition elements are burning, then a third ignition element such as a large log may be ignited for sustained burning in a fireplace or outside firepit.

Figure 4:
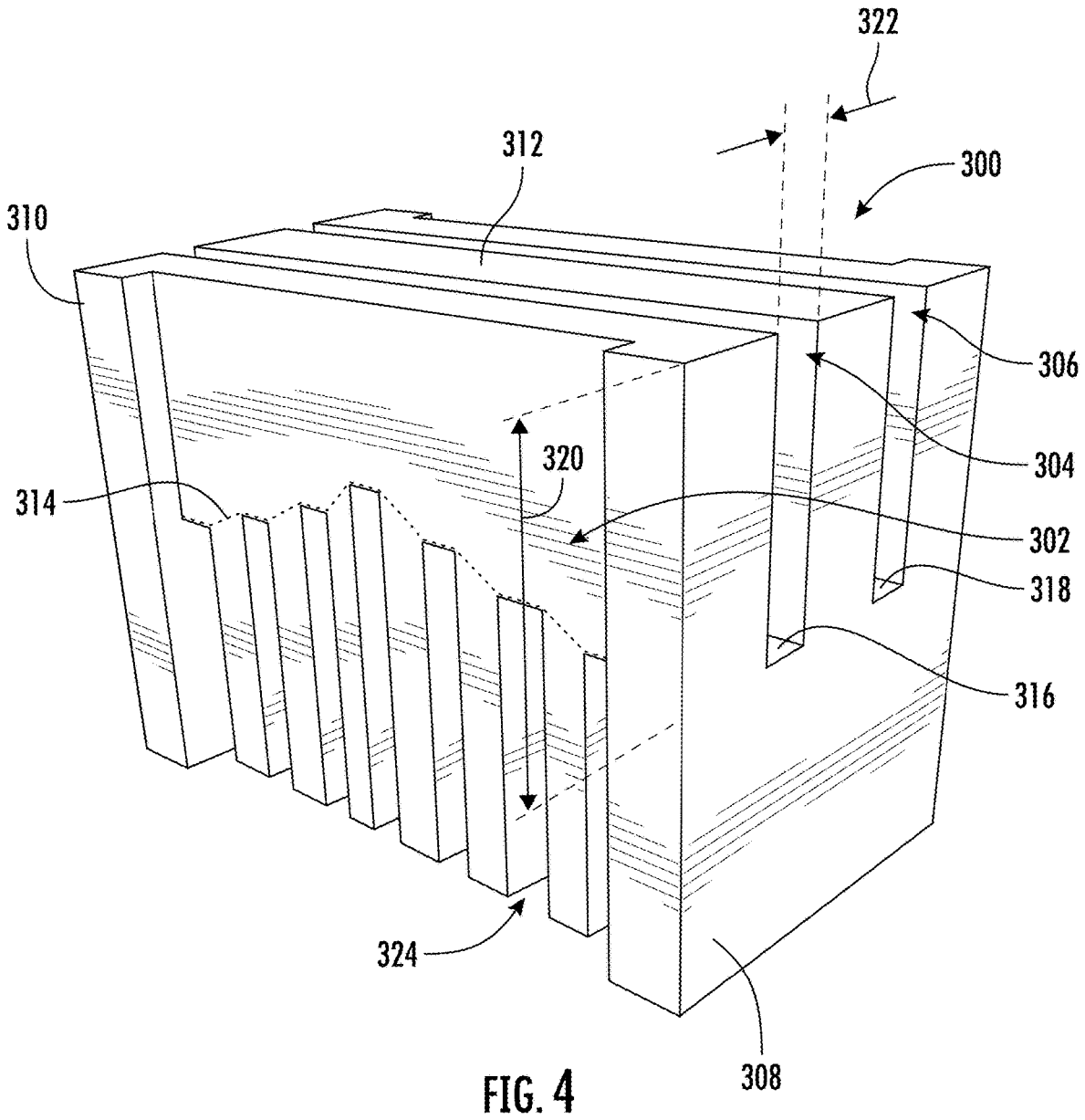
FIG. 4 a front right side and topside isometric view of a second embodiment of a firestarter according to the teachings of the instant invention.

FIG. 4 illustrates a second embodiment of a firestarter 300. Firestarter 300 is the same as firestarter 100 (FIG. 1) except for the differences described herein. The top wall 302 of firestarter 300 includes a first channel 304 spaced apart from a second channel 306. The first channel 304 and the second channel 306 are generally parallel to one another. By generally, it is meant within five degrees. The first channel 304 and the second channel 306 extend between and completely through the first side 308 and the second side 310 of the firestarter 300.

The first channel 304 extends from the top surface 312 of the top wall 302 through the concave surface 314 of the top wall 302 to a first channel bottom 316, wherein the second channel 306 extends from the top surface 312 of the top wall 302 through the concave surface 314 of the top wall 302 to a second channel bottom 318. The depth 320 of the first channel bottom 316 measured from the top surface 312 is the same depth 320 as the second channel bottom 318 measured from the top surface 312. The width 322 of the first channel 304 is the same width 322 of the second channel 306.

Figure 5:
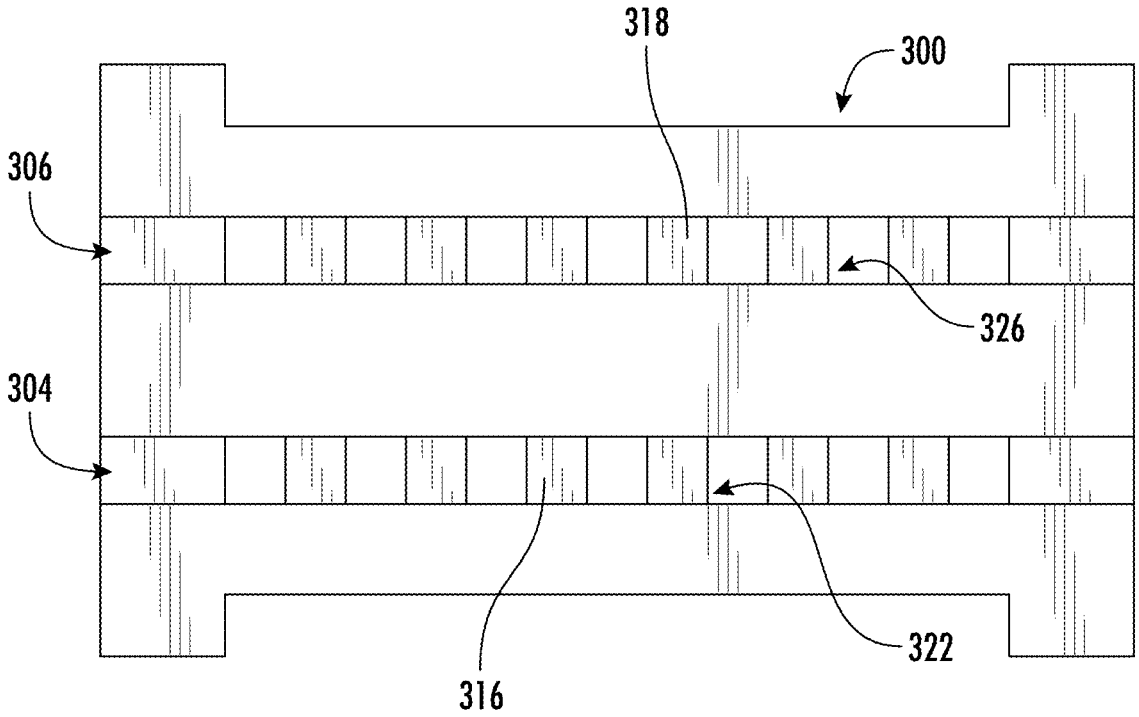
FIG. 5 is a top view of the firestarter of FIG. 4.

Turning to FIG. 5, the firestarter 300 includes a first plurality of linearly arrayed through-apertures 322 defined by the first channel bottom 316 to fluidly connect the first channel 304 with each one of the plurality of grooves 324 (FIG. 4). A second plurality of linearly arrayed through-apertures 326 are defined by the second channel bottom 318 to fluidly connect the second channel 306 with each one of the plurality of grooves 324 (FIG. 4).

The first plurality of linearly arrayed through-apertures 322 and the second plurality of linearly arrayed through-apertures 326 fluidly connecting, respectively, the first channel 304 and the second channel 306 to the plurality of grooves (FIG. 4) permit a controlled burn of the firestarter 300 which permits greater efficiency in starting a fire.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A firestarter comprising:

an integral block of wood of six sides comprising:

a top side opposite a bottom side;

a first side opposite a second side, the first side and the second side extending between the top side and the bottom side;

a front side opposite a back side, the front side and the back side each extending between the first side and the second side and between the top side and the bottom side;

a slat and groove portion extending from an outermost bottom surface of the bottom side towards a top wall of the top side; the slat and groove portion including a plurality of slats and a plurality of grooves;

wherein each slat of the plurality of slats has a slat width and each groove of the plurality of grooves has a groove width, the slat width and the groove width are the same;

wherein the plurality of grooves extend through the front side, the back side and the bottom side and the plurality of grooves do not extend through the first side, the second side and the top side;

wherein the top wall extends between a top surface of the top side and a concave surface located between the top side and the bottom side, the concave surface is a top wall bottom surface, each groove of the plurality of grooves extending from the top wall bottom surface to the outermost bottom surface.

2. The firestarter of claim 1, wherein a depth measured from the top surface to the concave surface is at least twice the slat width.

3. The firestarter of claim 1, wherein the concave surface comprises a first stepped surface intersecting a second stepped surface.

4. The firestarter of claim 1, wherein the concave surface faces the bottom side.

5. The firestarter of claim 1, wherein the top side includes a top outermost solid planar surface extending from the first side to the second side and from the front side to the back side.

6. The firestarter of claim 1, wherein the first side includes a first outermost solid planar surface extending from the front side to the back side and from the top side to the bottom side, the second side includes a second outermost solid planar surface extending from the first side to the second side and from the front side to the back side.

7. The firestarter of claim 6, wherein the back side defines a back channel into the back side, the back channel extending from the bottom side to the top side, the back channel defining a back channel bottom radially inward of an outermost portion of the back side, and wherein the front side defines a front channel in the front side, the front channel extending from the bottom side to the top side, the front side defining a front channel bottom radially inward of an outermost portion of the front side.

8. The firestarter of claim 7, wherein the slat and groove portion extends between the back channel and the front channel.

9. The firestarter of claim 8, wherein the front channel includes a first channel wall extending from the front channel bottom and a second channel wall opposite the first channel wall extends from the front channel bottom.

10. The firestarter of claim 9, wherein the back channel includes a third channel wall extending from the back channel bottom and a fourth channel wall extending from the back channel bottom.

11. The firestarter of claim 10, wherein the first channel wall width is measured from the first outermost solid planar surface to an innermost surface of the first channel wall, and the second channel wall width is measured from the second outermost solid planar surface to a second innermost surface of the second channel wall, wherein the first channel wall width and the second channel wall width are the same.

12. The firestarter of claim 11, wherein the first channel wall width and the second channel wall width are each twice as wide as the slat width.

13. The firestarter of claim 12, wherein the third channel wall width is measured from the first outermost solid planar surface to an innermost side of the third channel wall, and the fourth channel wall width is measured from the second outermost solid planar surface to the innermost side of the fourth channel wall, wherein the third channel wall width and the fourth channel wall width are the same as the first channel wall width and the second channel wall width.

14. The firestarter of claim 1, wherein each groove of the plurality of grooves has an opening aperture defined by the bottom surface.

15. The firestarter of claim 1, wherein the plurality of grooves includes a center groove bisected by a center axis of the integral block of wood, the center axis extending through the bottom side and the top side and bisecting a length of the integral block of wood, the length being the distance measured normal to the center axis and from the first side and the second side.

16. The firestarter of claim 15, wherein a first groove of the plurality of grooves is located proximate the first side and wherein proceeding in a direction from the first groove to the center groove, each groove of the plurality of grooves increases in groove depth, the groove depth defined as extending between a bottom surface of the bottom side and the concave surface, wherein the groove depth of the center groove is a center depth, the center depth is greater than the groove depth of each groove of the plurality of grooves that is not the center groove.

17. The firestarter of claim 16, wherein a last groove of the plurality of grooves is located proximate the second side, wherein proceeding in the direction from the center groove to the last groove of the plurality of grooves, the groove depth decreases.

18. The firestarter of claim 16, wherein each groove of the plurality of grooves defines a respective groove center axis, wherein the grooves of the plurality of grooves located the same groove distance from the center axis of the center groove have the same groove depth, the groove distance being measured from the center axis of the center groove to the respective center groove axis.

19. The firestarter of claim 1, wherein the top side defines a top surface having the shape of the capital letter I.

20. The firestarter of claim 1, wherein the top wall includes a first channel spaced apart from a second channel in parallel relation, the first channel and the second channel extending between and completely through the first side and the second side of the firestarter.

21. The firestarter of claim 20, wherein the first channel extends from the top surface of the top wall through the concave surface of the top wall to a first channel bottom, wherein the second channel extends from the top surface of the top wall through the concave surface of the top wall to a second channel bottom.

22. The firestarter of claim 21, wherein a first plurality of linearly arrayed through-apertures are defined by the first channel bottom and fluidly connect the first channel with each one of the plurality of grooves, wherein a second plurality of linearly arrayed through-apertures are defined by the second channel bottom and fluidly connect the second channel with each one of the plurality of grooves.

* * * * *